United States Patent [19]

Cowen

[11] 4,064,718

[45] Dec. 27, 1977

[54] NUMERICAL COMBINATION REPLACEMENT PLUG FOR CYLINDER LOCKS

[76] Inventor: Lloyd G. Cowen, 816 Leeds Drive, North Bellmore, N.Y. 11710

[21] Appl. No.: 772,460

[22] Filed: Feb. 28, 1977

[51] Int. Cl.[2] ..... E05B 37/04

[52] U.S. Cl. ..... 70/302; 70/311

[58] Field of Search ..... 70/115, 119, 122, 126, 70/133, 138, 213, 219, 285, 302, 303 R, 309, 311

[56] References Cited

U.S. PATENT DOCUMENTS

| | | | |
|---|---|---|---|
| 74,781 | 2/1868 | Wetzel | 70/302 |
| 374,712 | 12/1887 | Smith | 70/309 |
| 1,431,316 | 10/1922 | McCabe | 70/303 R |
| 1,816,575 | 7/1931 | Full | 70/219 |
| 1,987,925 | 11/1935 | Carlson | 70/303 R |
| 3,099,150 | 7/1963 | Check | 70/133 X |
| 3,196,643 | 7/1965 | Moss | 70/302 X |

FOREIGN PATENT DOCUMENTS

| | | | |
|---|---|---|---|
| 527,712 | 4/1954 | Belgium | 70/311 |
| 811,560 | 8/1951 | Germany | 70/303 R |
| 257,216 | 12/1926 | Italy | 70/311 |

*Primary Examiner*—Roy D. Frazier
*Assistant Examiner*—Thomas J. Holko
*Attorney, Agent, or Firm*—Charles E. Temko

[57] ABSTRACT

A replacement plug adapted to substitute a key operated plug and tumblers in an existing tumbler lock without extensive modification of an existing installation in a door, thereby reducing the possibility of mechanical picking of the tumblers which are thereby eliminated. The combination tumblers are disposed for rotation about an axis disposed at right angles relative to the axis of rotation of an actuating knob, which is mounted on an axially shiftable shaft. Selection of the proper combination frees the shaft for axially outward movement whereby a lock opening means is connected to the, actuating knob for the transmission of rotating motion to a lock bolt or other locking structure.

2 Claims, 8 Drawing Figures

FIG. 1
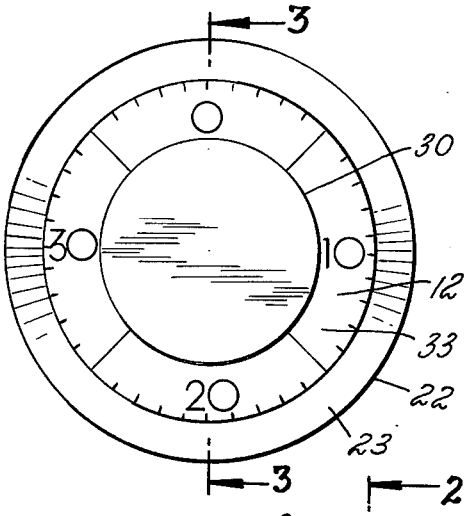
FIG. 2
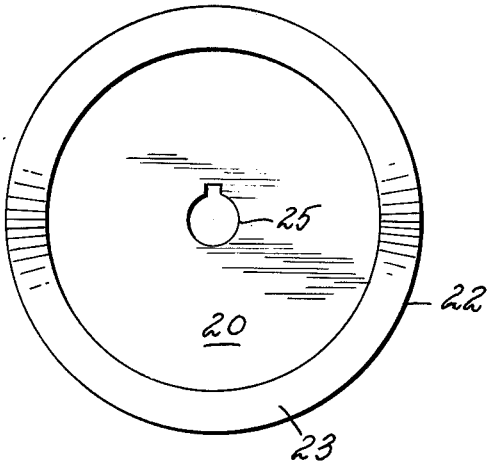
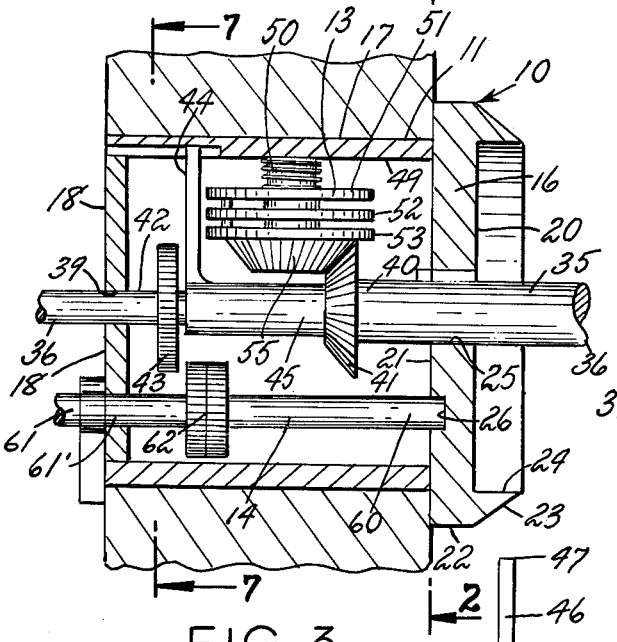
FIG. 3
FIG. 4
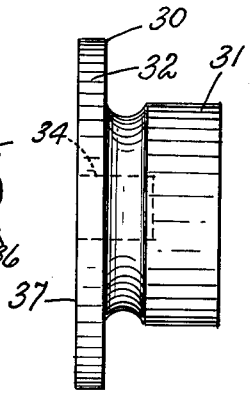
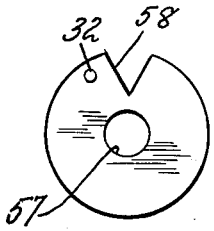
FIG. 5
FIG. 6
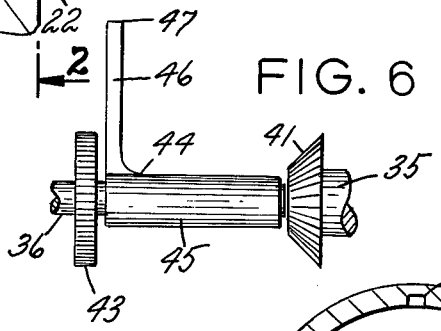
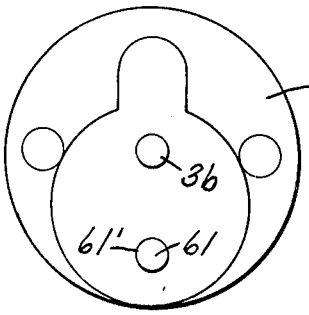
FIG. 8
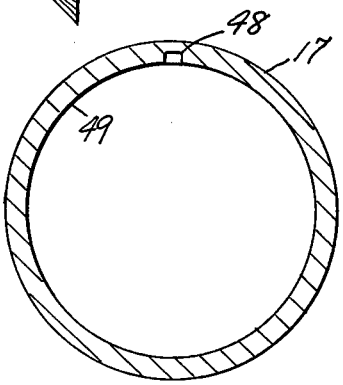
FIG. 7

NUMERICAL COMBINATION REPLACEMENT PLUG FOR CYLINDER LOCKS

BACKGROUND OF THE INVENTION

This invention relates generally to the field of conventional cylinder type door locks, and more particularly to an improved plug element of permutation type employing a plurality of combination tumblers adapted to replace an existing pin tumbler plug element.

Pin tumbler constructions employ a key having notches along the shank portion thereof which correspond to the heights of cylinder plug pins in a given lock. When inserted into the plug through an exposed opening, the proper key aligns all of the parallel pin tumblers in the lock such that the parting planes of each tumbler are in congruent relation with the surface of the plug permitting the plug to be turned to release a locking structure disposed therebehind. If an incorrect key is inserted, a difference of as little as one sixty fourths of an inch in any tumbler prevents the plug from turning. However, because of the presence of an opening in the exposed surface of the plug for the insertion of the key, the lock may be mechanically picked using a technique known as "torking" in which each tumbler is individually overcome in serial fashion by the insertion of an elongated picking tool.

Combination or mutation locks are well known in the lock art, and have been extensively used in padlocks and safe door constructions. While they are not totally immune to picking operations, considerably greater skills are necessary to overcome the combination tumblers which are not physically accessible to a potential lockpick. At the present state of the art, there is no conveniently available lock of permutation type suitable for use as a substitute for conventional lock sets.

SUMMARY OF THE INVENTION

Briefly stated, the invention contemplates the provision of an improved replacement plug for a conventional pin tumbler cylinder lock which may be installed in the plug opening of the cylinder with little or no modification of the surrounding structure. The novel construction includes a hollow housing of standard diameter having an axially centrally located main shaft, the outer end of which mounts a dial knob. The combination tumblers are mounted within the housing for rotation about an axis perpendicular to the axis of the main shaft, and are driven through a pair of bevel gears. The combination tumblers are in the form of flat discs, each having a radially inwardly extending opening or notch alignable with the corresponding opening or notch on each of the other tumblers with the dialing of the correct combination. When the notches are aligned, they accommodate a slidably mounted bar, movement of which permits the main shaft to move axially outwardly to engage a spur gear thereon with a spur gear on a motion output shaft disposed parallel to the main shaft, which in turn activates the lock mechanism. Relocking involves merely the return of the dial shafft to the original axial position within the housing, and rotating the dial knob to a random location.

BRIEF DESCRIPTION OF THE DRAWING

In the drawing, to which reference will be made in the specification, similar reference characters have been employed to designate corresponding parts through the several views.

FIG. 1 is a front elevational view of an embodiment of the invention.

FIG. 2 is a transverse sectional view thereof as seen from the plane 2—2 in FIG. 3.

FIG. 3 is a longitudinal fragmentary sectional view as seen from the plane 3—3 in FIG. 1.

FIG. 4 is a side elevational view of a dial knob member.

FIG. 5 is a view in elevation of one of a plurality of combination tumblers.

FIG. 6 is an enlarged fragmentary sectional view corresponding to the upper left hand portion of FIG. 3.

FIG. 7 is a transverse sectional view as seen from the plane 7—7 in FIG. 3.

FIG. 8 is a rear elevational view.

DETAILED DESCRIPTION OF THE DISCLOSED EMBODIMENT

In accordance with the invention, the device, generally indicated by reference character 10, comprises broadly: a housing element 11, a dial element 12, a tumbler element 13 and a motion output shaft element 14.

The housing element 11 includes a generally planar front wall 16, a cylindrical side wall 17 and a generally planar rear wall 18. To permit the device to be installed as a replacement plug, the side wall 17 must be of standardized dimensions, as for example, an outside diameter of $1\frac{1}{8}$ inch, and a depth of $1\frac{1}{8}$ inch. The cavity enclosed by the housing element is preferably of one inch diameter, which is adequate to permit free movement of the component parts described hereinbelow. The housing element is anchored within a cylindrical lock body (not shown) using means already present on the body, in well known manner. As the details of this interconnection form no part of the present disclosure, they need not be considered further.

The front wall 16 is bounded by an outer surface 20, an inner surface 21, and a peripheral surface 22 forming a part of a tapered flange 23 in turn forming a recess 24. A centrally disposed bore 25 interconnects the inner and outer surfaces 20–21, and a blind bore 26 extends inwardly from the inner surface 21 to form a bearing.

The dial element 12 includes a dial knob member 30 having a manually engagable knob portion 31 and a plate portion 32 having a suitable numerical scale 33 (FIG. 1) which is rotated against an index point (not shown) on the flange 23. A central bore 34 engages a centrally mounted first shaft 35 at an outer end 36 thereof, to which it is keyed. An inner surface 37 thereof abuts the outer surface 20 when the structure is in locked condition.

The inner end 36 of the shaft 35 is positioned within a bore 39 in the rear wall 18. A medial portion 40 thereof mounts a bevel gear 41, while a rear portion 42 mounts a spur gear 43.

FIG. 6 illustrates a bar member 44 having a cylindrical sleeve 45 carried by the shaft 35 and a laterally extending body 46, the outer end 47 thereof being carried by a groove 48 in the inner surface 49 of the cylindrical side wall 17.

The tumbler element 13 includes a shaft 50, one end of which is secured to the inner surface 49, and upon which first, second and third combination tumblers 51, 52 and 53, respectively, are mounted. Each of the tumblers is generally similar, and are interconnected by pins 32 (FIG. 5) to each other for limited relative rotational movement. The pin 59 of the third tumbler 53 interconnects that tumbler with a second bevel gear 55 selectively driven by the bevel gear 41. Each of the tumblers 51–53 includes a central bore 57 and a peripheral opening or notch 58, which, when aligned with the other openings or notches accommodates the bar member 44.

The motion output shaft element 14 is disposed in parallel relation with respect to the shaft 35, and includes a forward end 60 disposed in the recess 26 and a rearward end 61 carried in an opening 61 in the rear wall 18. A spur gear 62 selectively meshes with the spur gear 43.

The operation of the device 10 will be apparent from a consideration of FIG. 3. Assuming that the device is in locked condition, the proper combination is dialed to result in movement being transmitted from the dial element 12 to the tumbler element 13. When the individual tumblers 51–53 are aligned, space is provided for the accommodation of the bar member 44, which is engaged therein by pulling outwardly on the dial knob member 30. This action will disconnect the bevel gears 41 and 55, and engage the spur gears 43 and 62. The knob may then be rotated in the proper direction necessary to rotate the shaft element 14 to result in opening appropriate latching means (not shown).

To relock, the knob, while still in extended position, is rotated in an opposite direction to re-engage the latching means (or release the same if it is spring loaded), and the knob is then pushed inwardly to disengage the spur gears and re-engage the bevel gears. This movement will result in releasing the tumblers 51–53 for rotational movement as the bar member 44 clears the aligned openings 58, and the knob may then be rotated to a random setting to disalign the tumblers for a subsequent operation. In the case of the three tumblers shown, this is normally accomplished by rotating the knob through two or more full revolutions. It will be noted that the use of three tumblers is conventional, which are pressed together by a spring 65. However, if greater security is necessary, more tumblers (not shown) may be added.

I wish it to be understood that I do not consider the invention limited to the precise details of structure shown and set forth in this specification, for obvious modifications will occur to those skilled in the art to which the invention pertains.

I claim:

1. As a new article of manufacture, a plug for a cylinder type lock comprising: a hollow housing element including a planar front wall, a cylindrical side wall and a generally planar rear wall, said walls defining a cavity having a principal cylinder axis; a dial element including a first axially positioned shaft supported by said housing element for selective rotational and axial movement relative thereto, said shaft extending through an opening in said front wall at a front end thereof; a dial knob supported upon said front end of said first shaft, and a first medially positioned spur gear on said first shaft; a tumbler element carried by said housing element, and driven by said first shaft, said tumbler element including a plurality of planar circular tumbler members, each having an opening therein selectively alignable with corresponding openings in the other tumbler members and having pin means interconnecting the same for limited rotational relative movement; a bar member carried by said first shaft for axial movement thereon and freely rotatable relative thereto, said bar member being selectively positionable within aligned openings in said tumbler members, said bar member normally preventing outward axial movement of said shaft; a second motion output shaft element carried by said housing element, and having a second spur gear thereon selectively engagable with said first spur gear; whereby upon the dialing of a correct combination resulting in the alignment of said openings in said combination tumblers, said first shaft may be moved axially outwardly of said housing element to position said bar member within said openings, and engage said first and second spur gears for the transmission of rotary motion from said knob to said second shaft.

2. Structure in accordance with claim 1, further characterized in said tumbler element including a shaft carrying said tumbler members having an axis disposed at right angles relative to said first shaft, said tumbler element being driven by said first shaft through a pair of selectively engagable bevel gears.

* * * * *